US008297023B2

(12) United States Patent
Collins

(10) Patent No.: US 8,297,023 B2
(45) Date of Patent: Oct. 30, 2012

(54) STACKABLE COLUMN ASSEMBLIES AND METHODS OF CONSTRUCTION

(76) Inventor: William M Collins, Columbia, SC (US)

( * ) Notice: Subject to any disclaimer, the term of this patent is extended or adjusted under 35 U.S.C. 154(b) by 274 days.

(21) Appl. No.: 12/592,326

(22) Filed: Nov. 23, 2009

(65) Prior Publication Data

US 2010/0071305 A1 Mar. 25, 2010

Related U.S. Application Data

(63) Continuation-in-part of application No. 11/512,168, filed on Aug. 30, 2006, now abandoned.

(51) Int. Cl.

| | |
|---|---|
| ***E04H 12/00*** | (2006.01) |
| ***E04B 1/00*** | (2006.01) |
| ***E04B 5/00*** | (2006.01) |
| ***E04B 7/00*** | (2006.01) |
| ***E04B 1/38*** | (2006.01) |
| ***E04C 5/00*** | (2006.01) |
| ***E04C 3/00*** | (2006.01) |
| ***F16D 1/00*** | (2006.01) |

(52) U.S. Cl. ..... 52/655.1; 52/263; 52/283; 52/704; 52/848; 403/169

(58) Field of Classification Search ..... 403/305, 403/67, 165, 199, 337, 292, 169, 179; 52/263, 52/283, 655.1, 704, 848

See application file for complete search history.

(56) References Cited

U.S. PATENT DOCUMENTS

| | | | | | |
|---|---|---|---|---|---|
| 225,060 | A | * | 3/1880 | Johnson | 403/174 |
| 880,285 | A | * | 2/1908 | Eberhard | 52/283 |
| 1,024,615 | A | * | 4/1912 | Brown | 403/169 |
| 1,073,614 | A | * | 9/1913 | McDearmid | 405/251 |
| 1,188,485 | A | * | 6/1916 | Pruyn | 285/27 |
| 3,747,965 | A | * | 7/1973 | Wing | 403/173 |
| 4,409,765 | A | * | 10/1983 | Pall | 52/167.1 |
| 4,537,534 | A | * | 8/1985 | Marsh, Jr. | 405/252 |
| 5,148,642 | A | * | 9/1992 | Plumier et al. | 52/167.1 |
| 5,289,665 | A | * | 3/1994 | Higgins | 52/655.1 |
| 5,535,555 | A | * | 7/1996 | Boyd et al. | 52/99 |
| 5,680,737 | A | * | 10/1997 | Sheipline | 52/655.1 |

(Continued)

*Primary Examiner* — Joshua J Michener
*Assistant Examiner* — Andrew Triggs
(74) *Attorney, Agent, or Firm* — L. Lawton Rogers, III

(57) ABSTRACT

An improved stackable square tubular column assembly and method of assembly for multi-floor steel-framed buildings in which hollow columns for vertically adjacent floors are joined by a coupler having beam connectors extending outwardly therefrom so that the coupler supports the floor load in shear. The core of the assembly is the coupler having a flat plate extending through horizontal slots in opposing walls of the coupler that divides the coupler into two compartments, each compartment telescopingly receiving the end of a single floor column so that the column load of the upper column is uniformly distributed in compression over the walls of the lower column through the plate. Advantages of the various embodiments include (a) eliminating the necessity of column abutment, (b) eliminating the need for exact registration of the columns, (c) eliminating the need for through-column bolts, (d) eliminating the need for overhead welds, (e) improved tolerances for coupler-to-lower column tolerances, (f) improved resistance to bending or twisting of the coupler about the supporting column, (g) the addition of coupler-to-coupler tension cables, (h) additional support for metal decking, (i) the connection of stacked columns without through-column bolts, (j) coupler length reduction for reduced thickness composite floors without sacrificing resistance to floor load shear, (k) a continuous span for reduced thickness floors, (l) shear panels anchored to the structural steel columns, coupler and beams, and (m) the ability of the coupler to accommodate normal X-bracing and tube bracing.

20 Claims, 3 Drawing Sheets

U.S. PATENT DOCUMENTS 5,921,049 A * 7/1999 Sugiyama ..... 52/653.1
6,092,347 A * 7/2000 Hou ..... 52/648.1
7,037,030 B2 * 5/2006 McLemore ..... 404/6
7,143,988 B2 * 12/2006 Blateri ..... 248/343
7,351,013 B2 * 4/2008 Anderson ..... 405/232
7,354,224 B2 * 4/2008 Cinquano ..... 405/251
7,661,906 B2 * 2/2010 Austin ..... 405/251
2004/0221521 A1 * 11/2004 Schubert ..... 52/169.9
2008/0053020 A1 * 3/2008 Collins ..... 52/282.4
2010/0071305 A1 * 3/2010 Collins ..... 52/704

* cited by examiner

STACKABLE COLUMN ASSEMBLIES AND METHODS OF CONSTRUCTION

RELATED APPLICATIONS

This application is a continuation in part of co-pending application Ser. No. 11/512,168 filed Aug. 30, 2006, the content thereof is hereby incorporated herein by reference.

BACKGROUND OF THE INVENTION

The present invention relates to a improved stackable columns used in the construction of multi-floor steel-framed buildings and to methods of constructing such buildings using a stackable column. More particularly, the present invention relates to apparatus and methods of stacking and coupling together hollow vertical columns for supporting successive floors of a multi-floor steel-framed building. As disclosed infra, an integral part of the present invention is a novel coupler.

Multi-floor steel-framed buildings are typically constructed with columns spanning the full height of the building, with intermediate floors framed with structural beams or joints on which a floor is laid. For ease in erection, it is highly desirable to construct each multi-floor column by a series of single floor columns, with each column aligned with, and structurally connected to, the column on the floor above and below. The alignment is important for load bearing reasons and locating the column in the floor below is often problematic once the floor is in place. Each joint in the column represents a potential weak link and some overlapping and bracing connection of adjacent column members in the column is important. In many instances, the columns provide all of the lateral stability of the building in resisting high winds and seismic events.

The column on each floor must bear the weight of the floor/ceiling immediately above it (the "floor load"). The floor typically includes horizontal beams and the floor structure laid on such beams, e.g. composite metal deck overlaid with concrete. The support of such floor is generally transferred to the column by the attachment of the beams thereto in shear through beam connectors. The floor load may be, but often is not, the same for successive floors.

In addition to the floor load, each lower column must support (a) the upper column immediately above it together with any floor/ceiling structure such upper column supports and (b) any additional column(s) above the upper column together with any floor/ceiling structure supported by such additional columns (collectively, the "column load"). The column load typically diminishes as the building rises because the column on higher floors has fewer columns above it to support. Because the column load may be significantly different from the floor load, the methods of transferring the column load and the floor load to the columns may also be different.

The stackable column art is highly developed. It is common in the construction of multi-floor buildings such as government housing, college dormitories, and storage facilities, that the column load on each floor be supported in compression by the lower column, e.g. by direct abutment of the column walls of the upper and lower columns. In addition to vertical alignment, it is desirable that the shape and cross-section area of upper and lower columns be identical to maximize the transfer in compression of the load of the upper column to the walls of the lower column. However, this uniformity of column size and shape is often undesirable as the column load of successive floors typically diminishes as the building rises. Thus, there may be a desire to use smaller diameter and/or reduced cross-section columns on successive floors, i.e., each being adequate for the floor load and reduced column load it must bear. It one aspect, the present invention provides a stackable column that effects transfer of column load from an upper column to a lower column in compression without the necessity for exact column registration or abutment.

Because of the desire to use identical factory fabricated columns, the prior art has adopted the use of relatively short length couplers to telescopingly receive the ends of adjacent columns in a stack. Such couplers often are provided with laterally extending beam connectors to which the floor supporting beams are bolted on site.

The floor load is transferred through these connectors to the lower column by the attachment of the coupler to the lower column. The attachment of the beam connectors to the coupler is in shear, and known systems transfer the floor load from the coupler to the lower column in shear, by through-column fasteners or by welding the lower extremity of the coupler to the lower column. In another aspect, the present invention transfers the floor load from the coupler to the lower column in compression rather than shear.

If the coupler is attached in shear to the column by through-column bolts, the through-column apertures weaken the column and thus require increased column thickness and/or diameter. In addition, there are generally alignment problems with the prior art pre-punched apertures which may interfere with the abutting contact needed between the ends of the columns for the transfer of column load in compression. In addition, there is the risk that aperture misalignment may cause one of the two or more fasteners to take all of the shear load rather than sharing it, leading to successive fastener failure.

If the coupler is attached in shear to the column by welding, such welds typically are overhead welds which are very difficult to make on site. In addition, welding is possible only if the two metals are sufficiently close together, and the combination of variations manufacturing tolerances as to the size and shape on the columns and coupler may make welding the coupler to the column impossible without the use of filler bars.

It is an advantage of the present invention that both column load and floor load are transferred from the coupler to the lower column in compression and without welding to the column or the use of through-column apertures.

Floor loads are often unbalanced, e.g. the floor load is not the same on all four sides of columns at the corners of buildings or adjacent mezzanines. This result is an eccentricity or bending moment of the coupler about the column. The bean connectors of known prior art couplers are attached to the coupler both above and below the top of the lower column, and the bending moment is increased to the extent that it is applied at any point above the top of the lower column, In some embodiments, the present invention attaches the bean connectors to the coupler below the top of the lower column (See FIGS. 4 & 6) and thus materially reduces the bending moment that results from floor load. This reduction in the bending moment caused by the floor load is also beneficial in the transfer of column load (that includes such floor load) to the column beneath.

In some embodiments of the present invention, the length of the flat plate is extended so that the ends protrude beyond the external walls of the coupler. (See FIG. 7). This extension may be used to provide additional support for the metal deck laid on top of the beams. The extension may also be apertured and used for coupler-to-coupler tension cables. Thus, the present invention enhances building rigidity by coupler-to-coupler tension connections.

In other embodiments of the present invention, the width of the flat plate extending through the slots in opposing walls of the coupler is narrowed to created openings or slots between the lateral sides of the flat plate and the internal walls of the coupler. (See FIG. 8). Elongated column connector plates may be vertically inserted through such slots alongside the internal walls of the coupler. The ends of the connector plates that protrude above and below the coupler may be secured to the walls of the columns by welding or by piercing fasteners so as to avoid through-column apertures. The attachment of vertically adjacent of the stacked columns by these connector plates enhances the rigidity of the column and provides a tension and continuity connection. In still another aspect, the vertically adjacent columns of the present invention are connected in tension without through-column apertures.

It is known to support a composite steel-concrete floor by the beam connectors, i.e. to attach I-beams to the connectors of adjacent columns, to support corrugated metal decking on the upper flange of the I-beams, and to pour concrete over the decking. (See FIG. 6). The total thickness of the floor includes the height of the I-beam and the overlying composite floor. In construction where it is desirable to have less total floor thickness, it is known to support the decking on the upper surface of the lower flange of the I-beam, thus reducing the total thickness of the floor by the depth of the I-beams (See FIG. 10).

The reduced thickness of the floor requires a reduced height coupler (See FIG. 10), advantageous in that it permits the finishing of the concrete floor without the necessity of avoiding the upwardly extending couplers. However, this requires that the beam connectors extend both above and below the top of the lower column and this increases the risk of bending moments as discussed supra. This is offset by the extension of the flat plate beyond the coupler walls into the concrete which will resist any movement of the coupler.

The resistance to shear provided by the length of the weld of the beam connectors is also reduced, but the top of the beam connector may be horizontally extended to increase the weld length without increasing the height of the coupler. (See FIG. 11). Where unusual upward as well as the normal downward forces must be considered as required in many military applications, the lower end of the beam connector may also be horizontally extended and welded to the coupler, enhancing the strength of the coupler. (See FIG. 12).

There is an additional advantage of the present invention where the concrete of the composite floor rises to or slightly above the upper flange of the I-beams. The web of the beams may be apertured at spaced intervals and construction rebar inserted through the apertures. (See FIG. 13). When the concrete is poured, concrete also extends from one bay to the adjacent bay through these apertures around the rebar and thus provides a continuous span which increases the floor load capacity, increases the fire rating, reduces cracking and strengthens the beam/concrete composite action.

Additional rigidity and resistance to shear may be provided in the present invention by shear panels bounded by laterally adjacent columns, the floor and the bottom of the beam connecting the laterally adjacent columns. (See FIG. 14). Conventional C-shaped light gage metal tracks may be attached by piercing fasteners and C-shaped metal studs conventionally spaced along the tracks. A solid panel or decking may be attached to the studs to provide a skin or diaphragm. The use of shear panels in light gage construction is well known, but is of particular significance in the system of the present invention where the shear panels are anchored in structural steel columns and where the vertical connector plates efficiently transfer the chord forces of the shear wall in tension as well as compression.

Alternatively to shear panels, conventional X-bracing or tube bracing may be utilized. Where such bracing is desired, the coupler of the present invention may be modified (See FIG. 15) to vertically extend the attached beam connectors downwardly beyond the level of the beams to be attached, and upwardly above the level of the floor to be poured, to provide a place for the attachment of the structural steel angles (tension only) or tubes (compression and tension) used as braces.

The above and many other advantages will be readily apparent to one skilled in the art to which the invention pertains from a perusal of the claims, the appended drawings, and the following detailed description of the preferred embodiments.

THE DETAILED DESCRIPTION OF PREFERRED EMBODIMENTS

Figure 1:
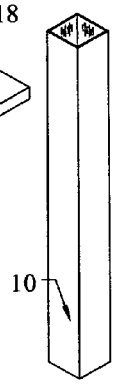
FIG. 1 is a pictorial illustration of one embodiment of a column member of the present invention.

With reference now to the figures where liked numerals are used to indicate like elements, one embodiment of the column member of the present invention is illustrated in FIG. 1 as being a steel tube 10 having a substantially uniform wall thickness and being generally square in cross-section. The column members may be fabricated in any conventional manner in a desired height, or fabricated and then cut to the desired height.

Figure 2:
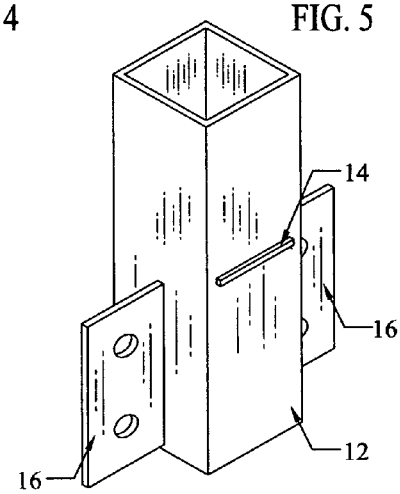
FIG. 2 is a pictorial illustration of one embodiment of a coupling member of the present invention.

One embodiment of the coupler is shown in FIG. 2 and comprises a relatively short section of a column member 12 dimensioned slightly larger than the column member 10 of FIG. 1 to telescopingly receive one end of two column members into opposite ends open ends.

Coupler 12 is divided intermediate its length at the approximate mid-point thereof by a horizontal plate 14. The coupler 12 may be fabricated by providing horizontal slots in two opposing sides of the coupler through which the plate 14 may be inserted and then welded into place.

The length of the lower portion of the coupler 12 desirably approximates the vertical height or web of the structural members used to support the floor between adjacent columns. Attached to two opposite sides of the lower portion of the coupler illustrated in FIG. 2 are beam or floor joist connectors 16 to which the floor supporting beams (not shown) may be attached by any suitable conventional means such as by bolts extending through apertures therein.

The length of the upper portion of the coupler 12 is desirably that of the thickness of the floor to be supported on the beams, e.g., for a composite steel/concrete floor, the combined thickness of the corrugated steel deck and the concrete poured thereon. Having the top of the coupler at the same level as the floor facilitates the finishing of the concrete of the floor. Where there is to be no load bearing floor but only a ceiling, and no additional column members supported thereon, the height of the upper portion of the coupler may be truncated. Because additional column members may be supported therein to which roof joists may be attached, and because there is an advantage in utilizing uniform parts, a standard height upper portion may be maintained even for the topmost column member.

If only a ceiling is to be attached to the beams, any suitable conventional roof construction may be attached to the upper or lower flange of the beams in any suitable conventional manner.

Figure 4:
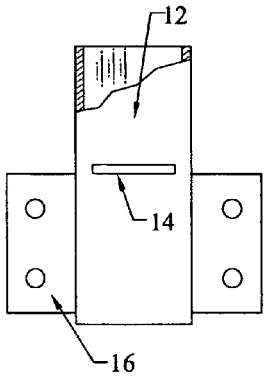
FIG. 4 is a front elevation in partial section of the coupler of FIG. 2.
Figure 5:
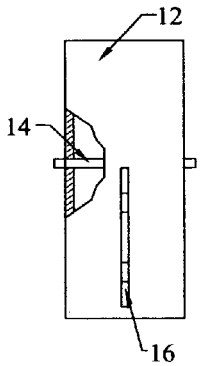
FIG. 5 is a side view in partial section of the coupler of FIG. 2.
Figure 3:
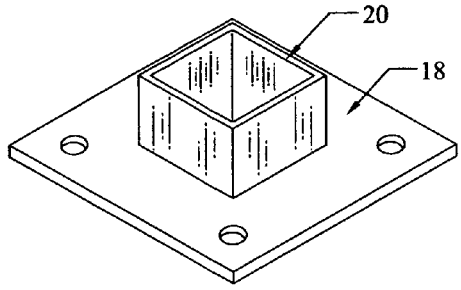
FIG. 3 is a pictorial illustration of one embodiment of a base plate of the present invention.

As shown in FIG. 3, a base plate 18 may be used to support the lower end of the column. This base plate may be a plate apertured for attachment in a conventional manner to the lowest floor, e.g., a concrete slab. The base plate may itself be apertured to receive the lowest end of the lowest column member, but preferably, as shown, include a portion of a tube 20 dimensioned like the coupler 12 to telescopingly receive and support a column member. Because slabs often are not level, and because the columns are typically precut to the same length, the effective slab height may effectively increased by placing one or more flat plates in the interior of the tube 20 to raise the bottom end of the column.

Figure 6:
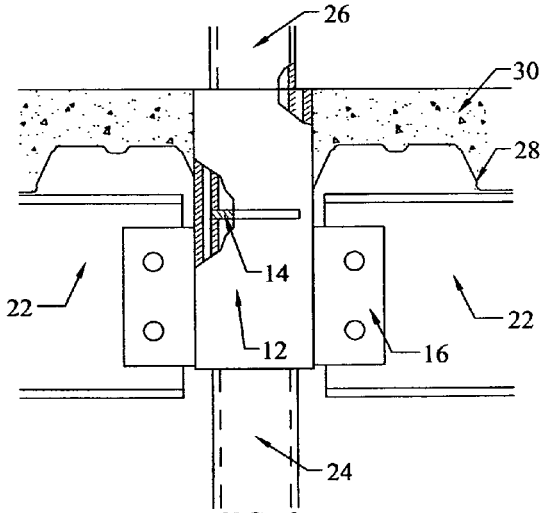
FIG. 6 is an illustration in partial section showing one embodiment of the assembly of two column members and one coupler with a composite floor.

As illustrated in FIG. 6, a joint in the column may comprise a coupler 12 that is supported on the upper end of a column member 24 by abutment of the upper surface thereof with the lower surface of the plate 14. The upper surface of the plate 14 of the coupler 12 in turn supports the lower end of a column member 26. Beams 22 are attached to the beam supports 16 in one, two, three or four directions as desired. A corrugated steel deck 28 is supported on the beams 22 and in turn support a layer of concrete 30 to form a composite floor. Note that the height of the coupler may provide a convenient guide for the depth of concrete to be poured, leaving the opening into the upper compartment of the coupler 12 exposed for subsequent insertion of the lower end of the upper column member 26. Note also that the overlap of the upper portion of the coupler 12 and the lower end of the column member 26 is supported against twisting or bending of the coupler in response to floor loads by the composite floor. Similarly, the overlap of the lower portion of the coupler 12 and the upper end of the column member 24 is supported against the twisting or bending of the coupler by the beans 22.

Figure 7:
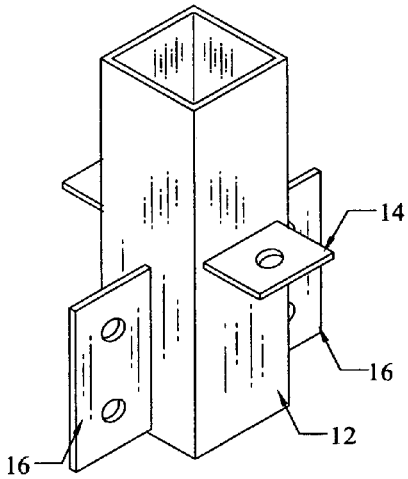
FIG. 7 is a pictorial illustration of a second embodiment of a coupler of the present invention showing the lateral extensions of the flat plate.

As shown in FIG. 7, the flat plate 14 may be made sufficiently long to protrude laterally beyond the walls of the coupler 12. One of the several advantages of such extensions is that they facilitate the connection of adjacent couplers on a floor by tension cable and can provide a surface for supporting the deck.

Assembly on site is possible without the use of heavy lifting equipment because of the relatively light weight and shortness of the column members 10. In one embodiment, base plates 18 are attached to a concrete slab in the desired locations, and the column members 10 for the first floor stood upright and inserted into the tubes 20 of the base plates 18. The column members 10 may be welded to the base plates once in place.

A coupler may then be placed over the upper end of the first floor column 10 and is supported thereon by the abutment of the bottom surface of the flat plate 14 against the top of the column 10 in compression. Alternatively, the coupler 12 may be inserted over the first floor column 10 prior to standing the first floor column upright. In still another embodiment, the coupler 12 may be placed on the column and secured thereto prior to shipment to the job site. If the coupler and column are assembled before raising, care must be taken to see that the flat plate and column abut, so that any load placed on the flat plate 14 will be transferred to the column in compression.

The floor beams 22 may then be raised and attached to the beam couplers 16 of the coupler 12, after which the floor may be built, typically by supporting conventional steel deck on the beams and pouring concrete thereover. The thickness of the floor may vary as desired, with the length of the coupler above the flat plate adjusted to match the desired depth of concrete pour. Upon completion of the floor, the alignment of the second floor column members with the first floor column members is assured by the visible coupler, and the process of erecting the second floor column members may be completed. Note that the column load of the second floor column is distributed evenly over the entire cross-section of the first floor column in compression through the plate in the coupler.

Figure 8:
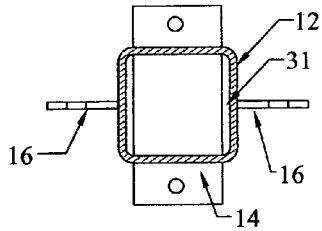
FIG. 8 is a plan view of an embodiment of the coupler with a narrowed plate.
Figure 9:
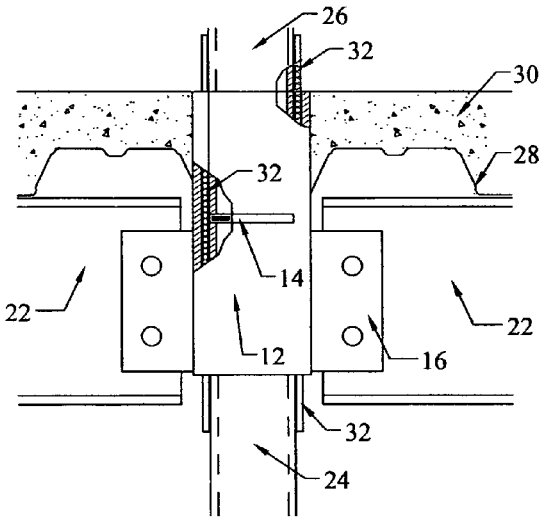
FIG. 9 is a side view in partial section of the coupler of FIG. 8 with the addition of the vertical connection plates.

As shown in FIG. 8, the flat plate 14 may be narrowed in width to leave a space 31 between the sides of the plate 14 and the interior wall of the coupler 12. An elongated flat connector plate 32 may then be inserted into the space 31 as shown in FIG. 9 and the ends of the connector plate 32 exposed both above and below the coupler 12 may be attached to the columns.

Figure 10:
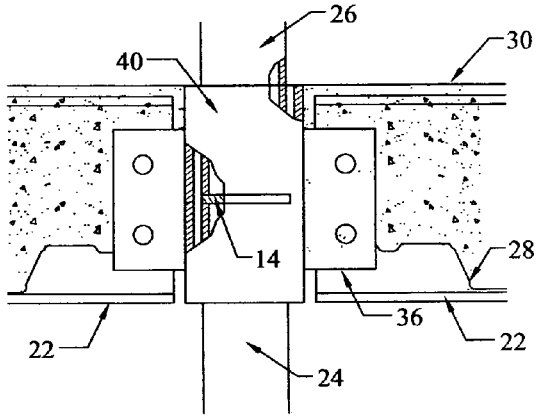
FIG. 10 is an elevation in partial section showing an embodiment of the assembly of two column members and one coupler with a composite floor. supported on the lower flange of the I-beams.
Figure 11:
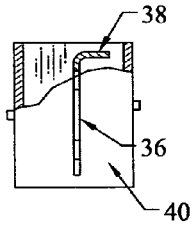
FIG. 11 is an elevation of a reduced height coupler with a L-shaped beam connector.
Figure 12:
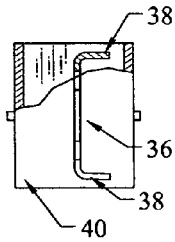
FIG. 12 is an elevation of a reduced height coupler with a C-shaped beam connector.

As shown in FIG. 10, the deck 28 may be supported on the upper surface of the lower flange of the I-beams 22 where a thinner floor desired. Concrete may be poured to a height equal to or slightly above the top of the beams 22.

Where the thickness of the floor is reduced, the length of the coupler must be shortened to eliminate obstructions to the finishing of the floor. The shortened coupler 40 will have less area available for attachment of beam connectors and the beam connectors 36 in this embodiment will be vertically shortened. This welding length for attachment of the shortened beam connectors 40 may be increased by providing horizontal extensions 38 on the top of the connector as shown in FIG. 11 or on both the top and bottom of the connectors as shown in FIG. 12.

Figure 13:
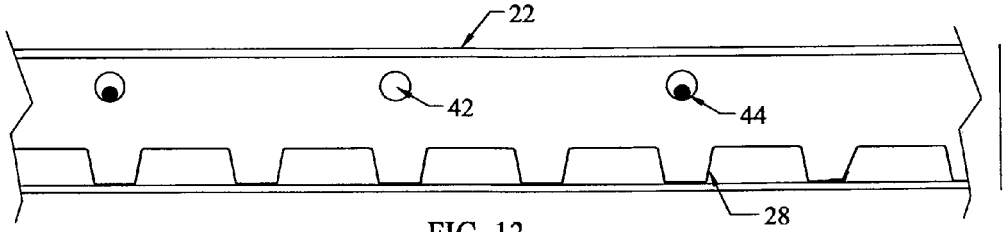
FIG. 13 is an partial elevation of a beam showing the decking installed on the lower flange of the beam with the location of through-beam apertures and rebar.

As shown in FIG. 10, concrete is in contact with the beams 22 providing composite interaction between the steel beam and concrete. As shown in FIG. 13, the web of the beams 22 may be provided with a series of apertures 42 and steel reinforcing rods 44 placed therein. Concrete can flow through the apertures 42 in contact with the steel rods and structurally connects adjacent bays of the floor.

Figure 14:
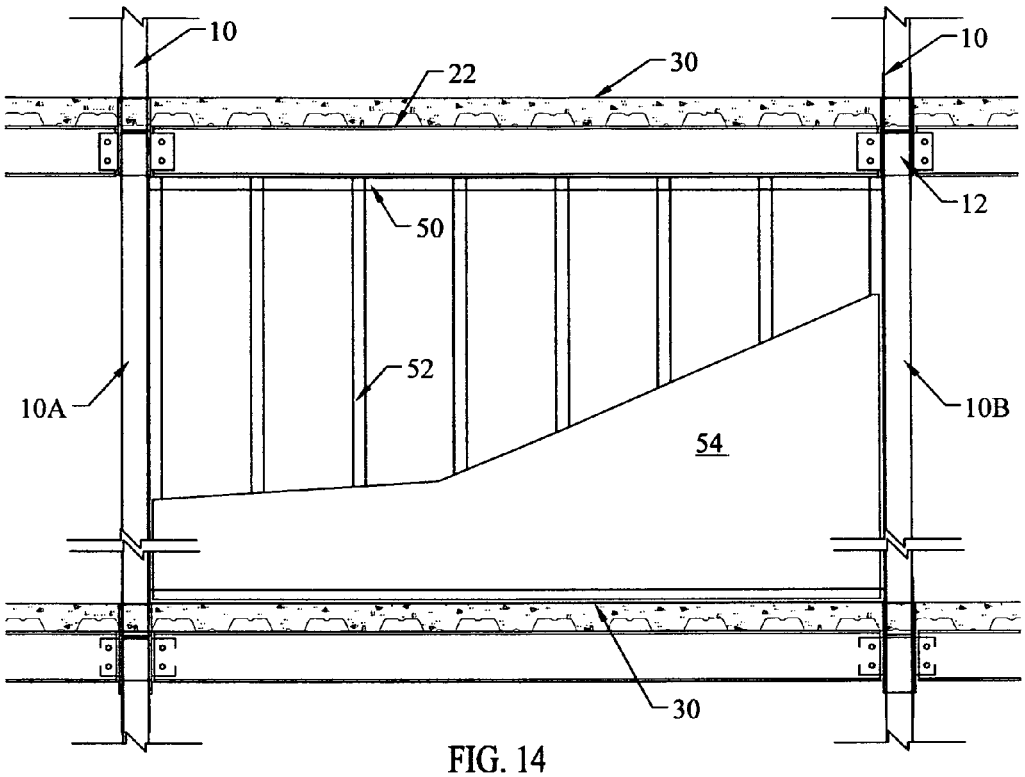
FIG. 14 is an elevation showing a light gage metal stud shear panel.

With reference to FIG. 14, a shear panel may be created and bounded by columns 10A and 10B, the beam 22 and the concrete floor 30. Conventional light gage C-shaped metal tracks 50 may be conventionally attached to the columns, the underside of the beam and the floor, and C-shaped metal studs conventionally attached to the upper and lower tracks 50. A skin or diaphragm 54 of any suitable material, e.g., metal deck or wooden panels, may be conventionally secured to the studs 52.

Figure 15:
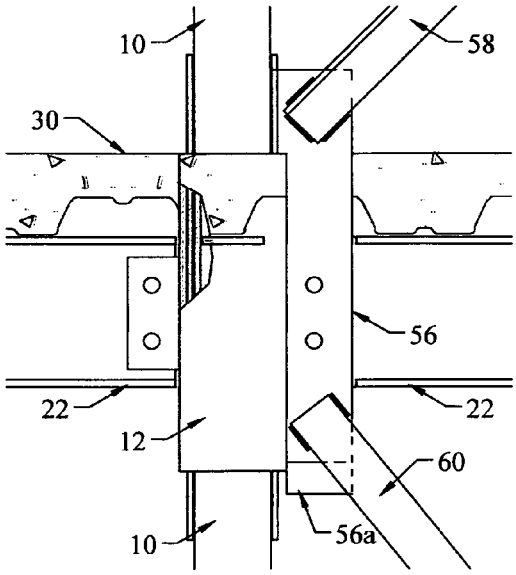
FIG. 15 is an elevation in partial section of the junction of two columns with another embodiment of a coupler modified to facilitate the attachment of X-braces or tube braces.

As an alternative to a shear panel, conventional X-bracing or rods may be used for additional rigidity. As shown in FIG. 15, the beam connectors of selected couplers may be vertically elongated to provide a plate 56, 56*a* to which the structural steel angles 58 or tubes 60 may be connected, typically by welding. Note that the connector extension may be above the coupler as shown above the floor or alternatively the coupler may also be extended as shown beneath the floor.

Because of the large number of potential patentable inventions in this application, e.g., a novel coupler for stackable columns, a novel stacked column using the coupler, a floor construction using a modified coupler, a coupler adapted for X-bracing and/or tube bracing, and the various methods disclosed, applicant has elected not to file independent claims directed to all of the disclosed inventions and reserves the right to pursue the patentability of such presently unclaimed inventions in divisional applications.

While preferred embodiments of the present invention have been described, it is to be understood that the embodiments described are illustrative only and the scope of the invention is to be defined solely by the appended claims when accorded a full range of equivalence, many variations and modifications naturally occurring to those of skill in the art from a perusal hereof.

What is claimed is:

1. In a stackable steel column assembly comprising rectangular steel upper and lower hollow columns and a rectangular steel coupler sized to receive the upper end of the lower column and the lower end of the upper column with the column load of said upper column being transferred to said lower column in compression, where the coupler has at least one beam connector extending laterally outwardly from a lateral side thereof on which a floor load is imposed in shear, and including means for limiting the vertical movement of said coupler relative to said lower column and for transferring any floor load imposed on the coupler to the lower column in shear, the improvement:

wherein the column load of said upper column is supported in compression by said lower column without abutment of said columns and without through-column apertures, and wherein the vertical movement of said coupler relative to said lower column is limited and the transfer of any floor load from said coupler to said lower column is effected without through-column apertures or the welding of said coupler to said lower column, wherein said coupler includes a flat steel plate extending through horizontal slots at the same height in opposing lateral sides of the coupler near the vertical midpoint thereof, the lower end of said upper column abutting said plate to transfer the column load thereto in compression and said plate abutting the upper end of said lower column to transfer thereto in compression any column load applied to said plate so that the column load is transferred from said upper column to said lower column through said plate in compression, said plate obviating the need for registration of the walls of said upper column with the walls of said lower column, the abutment of said plate with the upper end of said lower column limiting the downward movement of said coupler relative to said lower column and effecting transfer of any floor load from said coupler to said lower column in compression.

2. The improved stackable steel column assembly of claim 1 wherein said fiat plate extends sufficiently laterally outward from said coupler to provide a surface that is suitable for use as a point of attachment of coupler-to-coupler tension cables.

3. The improved stackable steel column assembly of claim 1 wherein said at least one beam connector is welded to said coupler below the level of said plate to thereby reduce the bending moment of said coupler about said lower column from any floor load placed on the coupler through said at least one beam connector.

4. The improved stackable steel column assembly of claim 3 wherein said at least one beam connector has at least one horizontal component in contact with said coupler to thereby increase the area of contact between said at least one beam connector and said coupler is increased, and wherein said horizontal component is welded to said at least one beam connector over at least a portion of said area of increased contact to thereby increase the resistance to shear.

5. The improved stackable steel column assembly claim 1 wherein said fiat plate has a horizontal width less than the internal width of said coupler to thereby provide openings between the lateral sides of said fiat plate and the adjacent internal wall of said coupler, said openings being sufficient for an elongated fiat connecting plate to pass vertically therethrough, and wherein said improvement further includes two elongated fiat connecting plates extending one each through one of said openings along an internal wall of said coupler and protruding a distance beyond the top and bottom of said coupler, the protruding portions of said connecting plates being attached to the immediately adjacent of said columns to thereby connect the columns to each other and to increase the rigidity and improve the tensile strength of the stacked columns.

6. A coupler for a stackable steel column assembly comprising rectangular steel upper and lower hollow columns sized to receive the upper end of the lower column and the lower end of the upper column with the column load of said upper column being transferred to said lower column in compression, the coupler having at least one beam connector extending laterally outwardly from a lateral side thereof on which a floor load is imposed in shear, the improvement:

wherein said coupler includes a flat steel plate extending through horizontal slots at the same height in opposing lateral sides of the coupler near the vertical midpoint thereof.

7. The improved coupler of claim 6, wherein the ends of said plate protrude beyond the coupler sufficiently to provide a surface that capable of use for floor support and as a point of attachment of coupler-to-coupler tension cables.

8. The improved coupler of claim 6, wherein said beam connectors extend vertically above the top of the coupler to provide a place for the attachment of bracing.

9. The improved coupler of claim 8, wherein said beam connectors extend vertically below the bottom of the said coupler to provide a place for the attachment of bracing.

10. The improved coupler of claim 6, wherein said flat plate has a horizontal width less than the internal width of said coupler to thereby provide openings between the lateral sides of said flat plate and the adjacent internal wall of said coupler, said openings being sufficient for an elongated flat connecting plate to pass vertically therethrough, and including two elongated flat connecting plates extending one each through one of said openings along an internal wall of said coupler and protruding a distance beyond the top and bottom of said coupler, the protruding portions of said connecting plates being adapted for attachment to the immediately adjacent of said columns to thereby connect the columns to each other and to increase the rigidity and improve the tensile strength of the stacked columns.

11. In a stacked rectangular steel hollow column assembly comprising upper and lower columns and a coupler receiving the lower end of the upper column and the upper end of the lower column and having at least one beam connector adapted to receive a floor load, the method of simultaneously supporting on the lower column (i) the column load of an upper column in compression and (ii) any the floor load imposed on the coupler beam connectors, comprising the steps of:

(a) dividing the coupler into upper and lower compartments by a fiat plate extending through opposing walls of the coupler so that the walls of the coupler support the plate in compression, (b) receiving the upper end of the lower column into the lower compartment of the coupler so that the lower column abuts the plate and supports the plate thereby supporting the coupler and any floor load placed thereon in compression, and (c) receiving the lower end of the upper column into the upper compartment so that the upper column abuts the plate and the column load of the upper column is supported by the plate in compression.

12. In a stackable steel column assembly comprising rectangular steel upper and lower hollow columns and a rectangular steel coupler sized to receive the upper end of the lower column and the lower end of the upper column with the column load of said upper column being transferred to said lower column in compression, where the coupler has at least one beam connector extending laterally outwardly from a lateral side thereof on which a floor load is imposed in shear, and including means for limiting the vertical movement of said coupler relative to said lower column and for transferring any floor load imposed on the coupler to the lower column in shear, the improvement:

wherein the column load of said upper column is supported in compression by said lower column without abutment of said columns and without through-column apertures, wherein the vertical movement of said coupler relative to said lower column is limited and the transfer of any floor load from said coupler to said lower column is effected without through-column apertures or the welding of said coupler to said lower column; and including two elongated flat connecting plates extending one each along an internal wall of said coupler and protruding a distance beyond the top and bottom of said coupler, the protruding portions of said connecting plates being welded to the immediately adjacent of said columns to thereby connect the columns to each other and to increase the rigidity and improve the tensile strength of the stacked columns.

13. The improved stackable steel column assembly of claim 12 wherein said means for limiting movement of said coupler extends sufficiently laterally outward from said coupler to provide a surface capable of use for floor support and as a point of attachment of coupler-to-coupler tension cables.

14. The improved stackable steel column assembly of claim 12 wherein said at least one beam connector is welded to said coupler below the level of means for limiting movement to thereby reduce the bending moment of said coupler about said lower column from any floor load placed on the coupler through said at least one beam connector.

15. The improved stackable steel column assembly of claim 14 wherein said at least one beam connector has at least one horizontal component in contact with said coupler to thereby increase the length of the weld of said at least one beam connector to said coupler and the resistance to shear.

16. A coupler for a stackable steel column assembly comprising rectangular steel upper and lower hollow columns sized to receive the upper end of the lower column and the lower end of the upper column with the column load of said upper column being transferred to said lower column in compression, the coupler having at least one beam connector extending laterally outwardly from a lateral side thereof on which a floor load is imposed in shear, the improvement:

wherein said coupler includes a flat steel plate extending through horizontal slots at the same height in opposing lateral sides of the coupler near the vertical midpoint thereof, said flat plate having a horizontal width less than the internal width of said coupler to thereby provide openings between the lateral sides of said flat plate and the adjacent internal wall of said coupler, said openings being sufficient for an elongated flat connecting plate to pass vertically therethrough, and two elongated flat connecting plates extending one each through one of said openings along an internal wall of said coupler and protruding a distance beyond the top and bottom of said coupler, the protruding portions of said connecting plates being adapted for attachment to the immediately adjacent of said columns to thereby connect the columns to each other and to increase the rigidity and improve the tensile strength of the stacked columns.

17. The improved coupler of claim 16, wherein the ends of said plate protrude beyond the coupler sufficiently to provide a surface capable of floor support and as a point of attachment of coupler-to-coupler tension cables.

18. The improved coupler of claim 16, wherein said beam connectors extend vertically above the top of the coupler to provide a place for the attachment of bracing.

19. The improved coupler of claim 18, wherein said beam connectors extend vertically below the bottom of the said coupler to provide a place for the attachment of bracing.

20. The method of claim 11 including the further step of positioning an elongated flat connecting plate between the lateral sides of the flat plate and the adjacent internal wall of the coupler with the ends thereof protruding a distance beyond the top and bottom of the coupler, the protruding portions of the connecting plates being adapted for attachment to the immediately adjacent of the columns to thereby connect the columns to each other and to increase the rigidity and improve the tensile strength of the stacked columns.

* * * * *